US006923864B2

(12) United States Patent
Dauchelle et al.

(10) Patent No.: US 6,923,864 B2
(45) Date of Patent: Aug. 2, 2005

(54) PLANT FOR THE DIP-COATING OF A METAL STRIP

(75) Inventors: Didier Dauchelle, Creil (FR); Hugues Baudin, Teteghem (FR); Patrice Lucas, Lyons (FR); Laurent Gacher, Sarreguemines (FR); Yves Prigent, Roberval (FR)

(73) Assignee: Sollac, Puteaux (FR)

( * ) Notice: Subject to any disclaimer, the term of this patent is extended or adjusted under 35 U.S.C. 154(b) by 0 days.

(21) Appl. No.: 10/415,517

(22) PCT Filed: Nov. 7, 2001

(86) PCT No.: PCT/FR01/03454

§ 371 (c)(1),
(2), (4) Date: Sep. 9, 2003

(87) PCT Pub. No.: WO02/38823

PCT Pub. Date: May 16, 2002

(65) Prior Publication Data

US 2004/0028832 A1 Feb. 12, 2004

(30) Foreign Application Priority Data

Nov. 10, 2000 (FR) ..... 00 14482

(51) Int. Cl.[7] ..... B05C 3/00

(52) U.S. Cl. ..... 118/423; 118/68; 118/67; 118/63

(58) Field of Search ..... 118/423, 419, 118/66–68, 63, 422; 427/433, 434.2, 349

(56) References Cited

FOREIGN PATENT DOCUMENTS

JP 8-209318 * 8/1996

OTHER PUBLICATIONS

Patent Abstracts of Japan, vol. 014, No. 137, Mar. 15, 1990 & JP 02 011742 (Kawasaki Steel Corp), Jan. 16, 1990.

Patent Abstracts of Japan, vol. 018, No. 068, Feb. 4, 1994 & JP 05 79827 (Kawasaki Steel Corp), Oct. 26, 1993.

Patent Abstracts of Japan, vol. 015, No. 345, Sep. 3, 1991 & JP 03 134146 (Nippon Steel Corp), Jun. 7, 1991.

Patent Abstracts of Japan, vol. 016, No. 375, Aug. 12, 1992, & JP 04 120258 (Kawasaki Steel Corp), Apr. 21, 1992.

Patent Abstracts of Japan, vol. 013, No. 479, Oct. 18, 1989 & JP 01 188656 (Nisshin Steel Co. Ltd.), Jul. 27, 1989.

Patent Abstracts of Japan, vol. 099, No. 066, Mar. 26, 1985 & JP 59 197554 (Kawasaki Seitetsu K.K.), Nov. 9, 1984.

Patent Abstracts of Japan, vol. 13, No. 011, Jan. 11, 1989 & JP 63 219559 (Kubota Ltd.), Sep. 13, 1988.

* cited by examiner

*Primary Examiner*—Brenda A. Lamb
(74) *Attorney, Agent, or Firm*—Sughrue Mion, PLLC

(57) ABSTRACT

The subject of the invention is a plant for the continuous dip-coating of a metal strip (1), of the type comprising a tank (11) containing a liquid metal bath (12), a duct (13) through which the metal strip (1) runs and the lower end (13*a*) of which duct (13) is extended by at least two internal walls (20; 22) each located on one side of the strip (1) and directed towards the surface of the metal bath (12) in order to form at least one compartment (21; 23) for recovering the metal oxide particles and intermetallic compound particles. The duct (13) has a fixed upper part (30) and a movable lower part (31) joined together by a deformable element (32) and means (35) for positioning the movable lower part (31) with respect to the metal strip (1).

7 Claims, 3 Drawing Sheets

PLANT FOR THE DIP-COATING OF A METAL STRIP

BACKGROUND OF THE INVENTION

The present invention relates to a plant for the continuous hot dip-coating of a metal strip, especially a steel strip.

In many industrial applications, steel sheet is used which is coated with a protective layer., for example for corrosion protection, and usually coated with a zinc layer.

This type of sheet is used in various industries to produce all kinds of parts, in particular visual parts.

To obtain this kind of sheet, continuous dip-coating plants are used in which a steel strip is immersed in a bath of molten metal, for example zinc, which may contain other chemical elements, such as aluminium and iron, and possible addition elements such as, for example, lead, antimony, etc. The temperature of the bath depends on the nature of the metal, and in the case of zinc the temperature of the bath is around 460° C.

In the particular case of hot galvanising, as the steel strip runs through the molten zinc bath, an Fe—Zn—Al intermetallic alloy with a thickness of a few tens of nanometres forms on the surface of the said strip.

The corrosion resistance of the parts thus coated is provided by the zinc, the thickness of which is controlled usually by air wiping. The adhesion of the zinc to the metal strip is provided by the layer of the aforementioned intermetallic alloy.

Before the steel strip passes through the molten metal bath, this steel strip firstly runs through an annealing furnace in a reducing atmosphere where the purpose is to recrystallise it after the substantial work hardening resulting from the cold-rolling operation and to prepare its surface chemical state so as to favour the chemical reactions necessary for the actual dip-coating operation. The steel strip is heated to about 650 to 900° C. depending on the grade, for the time needed for recrytallisation and surface preparation. It is then cooled to a temperature close to that of the bath of molten metal by means of heat exchangers.

After it has passed through the annealing furnace, the steel strip runs through a duct, also called a "snout", containing an atmosphere which protects the steel, and is immersed in the bath of molten metal.

The lower end of the duct is immersed in the bath of metal in order to define, with the surface of the said bath and inside this duct, a liquid seal through which the steel sheet passes as it runs through the said duct.

The steel strip is deflected by a roller immersed in the metal bath. It emerges from this metal bath and then passes through wiping means used to regulate the thickness of the liquid metal coating on this steel strip.

In the particular case of hot galvanizing, the surface of the liquid seal inside the duct is generally covered with zinc oxide, coming from the reaction between the atmosphere inside this duct and the zinc of the liquid seal, and with solid dross or intermetallic compound particles coming from the steel strip dissolution reaction.

These dross or other particles, in supersaturation in the zinc bath, have a density less than that of the liquid zinc and rise to the surface of the bath and especially to the surface of the liquid seal.

The running of the steel strip through the surface of the liquid seal causes entrainment of the stagnant particles. These particles entrained by the movement of the liquid seal, which depends on the speed of the steel strip, are not removed from the volume of the bath and emerge in the region where the strip is extracted, creating visual defects.

Thus, the coated steel strip has visual defects which are magnified or revealed during the zinc wiping operation.

This is because the foreign particles are retained by the air wiping jets before the said particles are ejected or broken up, thus creating streaks of lesser thickness in the liquid zinc having a length ranging from a few millimetres to a few centimetres.

Various solutions have been proposed to try to remove the zinc particles and the dross from the surface of the liquid seal.

A first solution for avoiding these drawbacks consists in cleaning the surface of the liquid seal by pumping off the zinc oxides and dross coming from the bath.

These pumping operations allow the surface of the liquid seal to be cleaned only very locally at the point of pumping and their effectiveness and range of action are very low, which does not guarantee that the liquid seal through which the steel strip passes is completely cleaned.

A second solution consists in reducing the area of the liquid seal at the point through which the steel strip passes by placing a sheet-metal or ceramic plate at this liquid seal in order to keep some of the particles present at the surface away from the strip and to achieve self-cleaning of the liquid seal by this strip.

This arrangement does not keep away all the particles present at the surface of the liquid seal and the self-cleaning action is greater the smaller the area of the liquid seal, this being incompatible with industrial operating conditions.

Furthermore, after a given operating time, the store of particles outside the plate becomes greater and greater and clusters of particles end up being detached and coming back onto the steel strip.

The addition of a plate emerging at the surface of the liquid seal also forms a preferential site for trapping zinc dust.

Another solution consists in adding a frame to the surface of the liquid seal in the duct and surrounding the steel strip.

This arrangement does not make it possible to remove all the defects associated with the entrainment of zinc oxides and dross caused by the running of the steel strip.

This is because the zinc vapour at the liquid seal will condense on the walls of the frame and at the slightest disturbance, brought about by the vibrations or thermal inhomogeneities of the immersed strip, the walls of the frame become fouled and thus become regions of retention of foreign matter.

This solution can therefore operate only for a few hours, at best a few days, before itself becoming an additional cause of defects.

Thus, this solution deals only partly with the liquid seal and does not make it possible to achieve a very low defect density satisfying the requirements of customers desiring surfaces free of visual defects.

Also known is a solution which aims to clean the liquid seal by replenishing the bath of molten metal.

The replenishment is achieved by introducing pumped liquid zinc into the bath near the region where the steel sheet is immersed.

There are great difficulties in implementing this solution.

This is because it requires an extremely high pumping rate in order to provide an overflow effect and the pumped zinc injected at the liquid seal contains dross generated in the zinc bath.

Moreover, the pipe for replenishing the liquid zinc may cause scratches on the steel strip before it is immersed and is itself a source of defects caused by the accumulation of condensed zinc vapours above the liquid seal.

Also known is a process based on the replenishment of zinc at the liquid seal and in which this replenishment is accomplished by means of a stainless steel box surrounding the steel strip and emerging at the surface of the liquid seal. A pump sucks off the particles entrained by the overflow thus created and delivers them into the volume of the bath.

This process also requires a very high pumping rate in order to maintain a permanent overflow effect insofaras the box surrounding the strip in the volume of the bath above the bottom roller cannot be hermetically sealed.

SUMMARY OF THE INVENTION

The object of the invention is to provide a plant for the continuous galvanising of a metal strip which makes it possible to avoid the above-mentioned drawbacks and to achieve the very low density of defects meeting the requirements of customers desiring surfaces free of visual defects.

For this purpose, the subject of the invention is also a plant for the continuous dip-coating of a metal strip, of the type comprising:

a tank containing a liquid metal bath, a duct through which the metal strip in a protective atmosphere runs and the lower end of which duct is immersed in the liquid metal bath in order to define with the surface of the said bath, and inside this duct, a liquid metal seal, a roller, placed in the metal bath, for deflecting the metal strip and means for wiping the coated metal strip on leaving the metal bath, characterised in that the duct is extended, in its lower part, by at least two internal walls each located on one side of the strip and directed towards the surface of the metal bath in the said duct in order to form at least two compartments for recovering the metal oxide particles and intermetallic compound particles and in that this duct has a fixed upper part and a movable lower part joined together by a deformable element and means for positioning the movable lower part of the said duct with respect to the metal strip.

According to other features of the invention:

the deformable element is formed by a bellows made of stainless steel;

the positioning means comprise an actuating member linked to the movable lower part of the duct in order to move this lower part by pivoting about an axis transverse to the strip and located in the region of the bellows;

the positioning means comprise two actuating members linked to the movable lower part of the duct in order to move this lower part by pivoting about an axis transverse to the strip and located in the region of the bellows and/or by translation parallel to the surface of the liquid metal bath;

the actuating members are formed by hydraulic or pneumatic cylinders.

BRIEF DESCRIPTION OF THE DRAWINGS

Further features and advantages of the invention will become apparent from the description which follows, given by way of example, with reference to the appended drawings in which.

DETAILED DESCRIPTION OF THE INVENTION

In the following, a description will be given in the case of a plant for the continuous galvanising of a metal strip. However, the invention applies to any continuous dip-coating process in which surface pollution may occur and for which a clean liquid seal must be maintained.

Firstly, on leaving the cold-rolling mill train, the steel strip 1 passes, in a reducing atmosphere, through an annealing furnace (not shown) for the purpose of recrystallising it after the substantial work hardening resulting from the cold rolling, and to prepare its chemical surface state so as to favour the chemical reactions needed for the galvanising operation.

The steel strip is heated in this furnace to a temperature of between, for example, 650 and 900° C.

Figure 1:
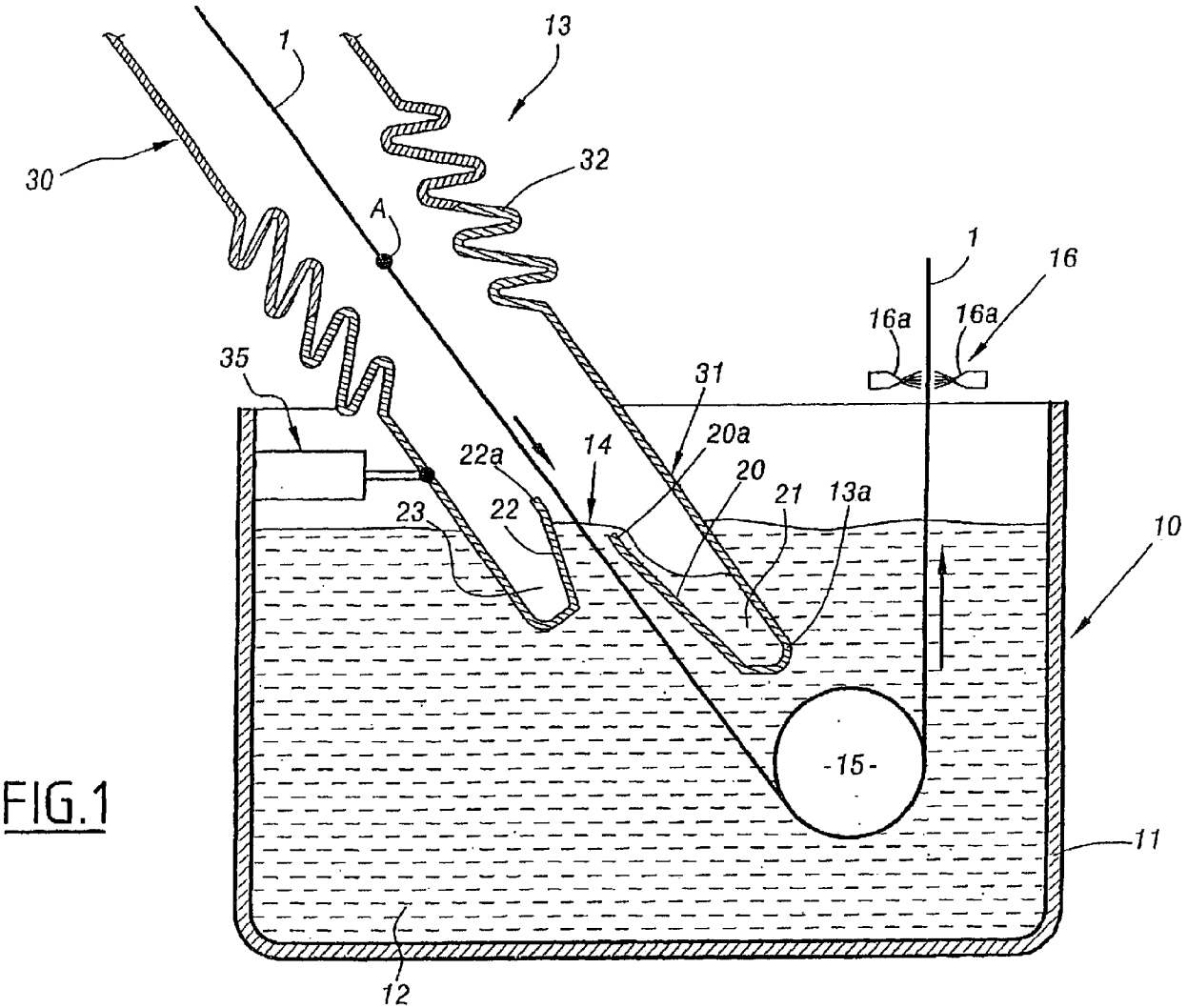
FIG. 1 is a schematic side view of a continuous dip-coating plant according to the invention.

On leaving the annealing furnace, the steel strip 1 passes through a galvanising plant, shown in FIG. 1 and denoted by the overall reference 10.

This plant 10 comprises a tank 11 containing a bath 12 of liquid zinc which contains chemical elements such as aluminium and iron and possible addition elements such as, in particular, lead and antimony.

The temperature of this liquid zinc bath is around 460° C.

On leaving the annealing furnace, the steel strip 1 is cooled to a temperature close to that of the liquid zinc bath by means of heat exchangers and is then immersed in the liquid zinc bath 12.

During this immersion, an Fe—Zn—Al intermetallic alloy is formed on the surface of the steel strip 1, producing a zinc coating whose thickness depends on the residence time of the steel strip 1 in the liquid zinc bath 12.

As shown in FIG. 1, the galvanising plant 10 includes a duct 13 within which the steel strip 1 runs in an atmosphere which protects the steel.

This duct 13, also called "snout", has, in the illustrative example shown in the figures, a rectangular cross-section.

The lower end 13*a* of the duct 13 is immersed in the zinc bath 12 so as to define with the surface of the said bath 12, and inside this duct 13, a liquid seal 14.

Thus, the steel strip 1 on being immersed in the liquid zinc bath 12 passes through the surface of the liquid seal 14.

The steel strip 1 is deflected by a roller 15, usually called the bottom roller, placed in the zinc bath 12. On leaving this zinc bath 12, the coated steel strip 1 passes through wiping means 16 which consist, for example, of air spray nozzles 16*a* and which are directed towards each side of the steel strip 1 in order to regulate the thickness of the liquid zinc coating.

As shown in FIG. 1, the lower end 13*a* of the duct 13 is extended, on the side facing that side of the strip 1 lying on the same side as the deflector roller 15, by an internal wall 20 which is directed towards the surface of the liquid seal 14 and makes, with the duct 13, a liquid zinc overflow compartment 21, in order to collect the zinc oxide particles and intermetallic compound particles which float on the surface of the liquid seal 14.

For this purpose, the upper edge 20*a* of the internal wall 20 is positioned below the surface of the liquid seal 14 and the compartment 21 is provided with means, not shown, for maintaining the level of liquid zinc in the said compartment at a level below the surface of the liquid seal 14 in order to set up a natural flow of the liquid zinc from this surface of the said seal 14 towards this compartment 21.

Moreover, the lower end 13*a* of the duct 13, located so as to face that side of the strip 1 placed on the opposite side from the deflector roller 15, is extended by an internal wall 22 directed towards the surface of the liquid seal 14 and making with the duct 13 a sealed compartment 23 for storing zinc oxide particles.

The upper edge 22*a* of the internal wall 22 is positioned above the surface of the liquid seal 14.

In this case, this compartment 23 serves as a receptacle for the zinc oxide particles which may come from the inclined lower wall of the duct and allows these oxide particles to be stored so as to protect the steel strip 1.

According to a variant, the upper edge 22*a* of the internal wall 22 may be positioned below the surface of the liquid seal 14 and, in this case, the compartment 23 is a liquid zinc overflow compartment, like the compartment 21.

In order for this system to operate in an optimized manner, the steel strip 1 must penetrate into the liquid zinc seal 14 without any risk of touching the walls 20 and 22 of the two compartments 21 and 23.

The line along which the steel strip 1 passes between the walls 20 and 22 of the two compartments 21 and 23 is determined by the diameter of the deflector roller 15 and by its position.

In addition, a modification in the position of the lower end 13*a* of the duct 13 with respect to the steel strip 1 occurs each time the roller 15 is changed.

To do this, the duct 13 has two parts, a fixed upper part 30 and a movable lower part 31, joined together by a deformable element 32 so as to be able to modify the position of the movable lower part 31 of the duct 13. The deformable element 32 consists of a bellows, for example made of stainless steel, and the lower part 31 of the duct 13 is associated with means 35 for positioning the internal walls 20 and 22 with respect to the steel strip 1.

Figure 2:
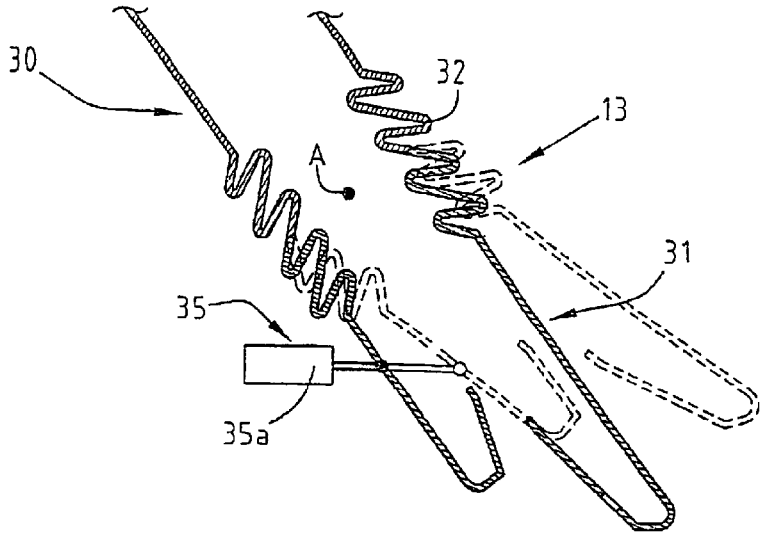
FIG. 2 is a schematic view on a larger scale of a first embodiment of the means for positioning the duct of the plant according to the invention.

According to a first embodiment shown in FIG. 2, the positioning means 35 comprise an actuation member 35*a* consisting, for example, of a hydraulic or pneumatic cylinder linked to the movable lower part 31 of the duct 13 in order to move this lower part 31 by pivoting about a virtual axis A transverse to the strip 1 and located in the region of the bellows 32.

Thus, by actuating the cylinder 35*a*, the free end of whose rod is mounted so as to pivot on the movable lower part 31, the angle of inclination of this lower part 31 may be modified according to the inclination of the steel strip 1, as shown in dotted lines in FIG. 2.

Figure 3:
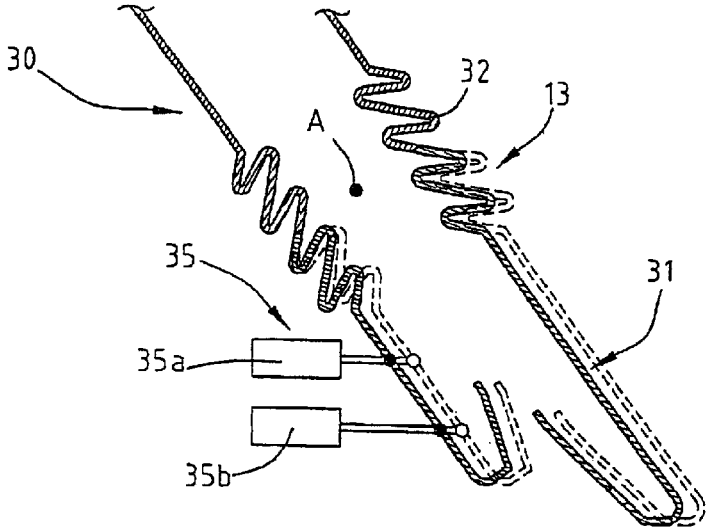
FIGS. 3 and 4 are schematic views on a larger scale of a second embodiment of the means for positioning the duct of the plant according to the invention.
Figure 4:
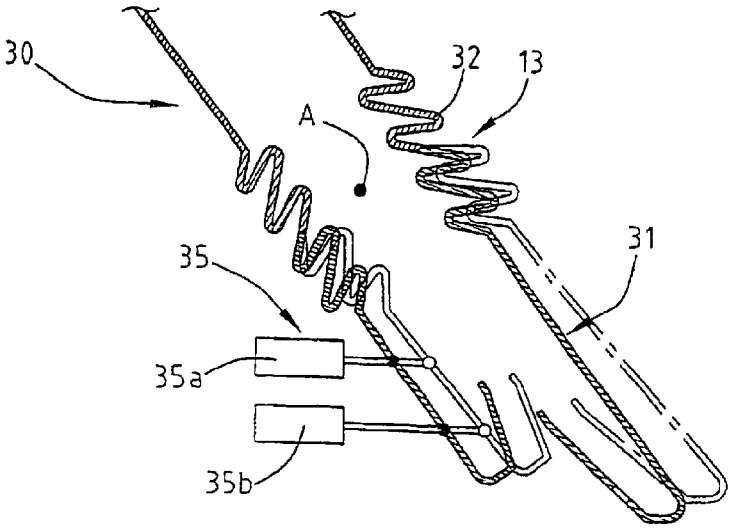

According to a second embodiment shown in FIGS. 3 and 4, the positioning means 35 comprise two actuation members, 35*a* and 35*b* respectively, consisting, for example, of hydraulic or pneumatic cylinders linked to the lower part 31 of the duct 13.

Thus, by acting on the two cylinders 35*a* and 35*b*, the movable lower part 31 of the duct 13 is moved in translation parallel to the surface of the liquid metal bath 12 when the displacement travel of the actuation rods of the said cylinders is identical, as shown in FIG. 3. In this case, the movable lower part 31 remains parallel to itself.

Moreover, by acting on the two cylinders 35*a* and 35*b* with a different displacement travel for each actuation rod of the said cylinders, the lower movable part 31 is moved by pivoting about the transverse virtual axis and by translation parallel to the surface of the liquid metal bath 12, as shown in FIG. 4.

This arrangement has the advantage of making it possible to adjust, independently, on the one hand, the position of the movable part 31 of the duct 13 with respect to the steel strip 1 and, on the other hand, the horizontality of the said movable part. This also makes it possible to balance the flow of liquid metal running into each compartment 21 and 23 and consequently increase the effectiveness of the plant.

By moving the movable lower part 31 of the duct 13 by pivoting and/or by translation, the position of the internal walls 20 and 22 of the compartments 21 and 23 is adjusted so that the steel strip 1 penetrates the liquid zinc seal 14 determined by the said internal walls 20 and 22 without any risk of touching these walls.

Figure 5:
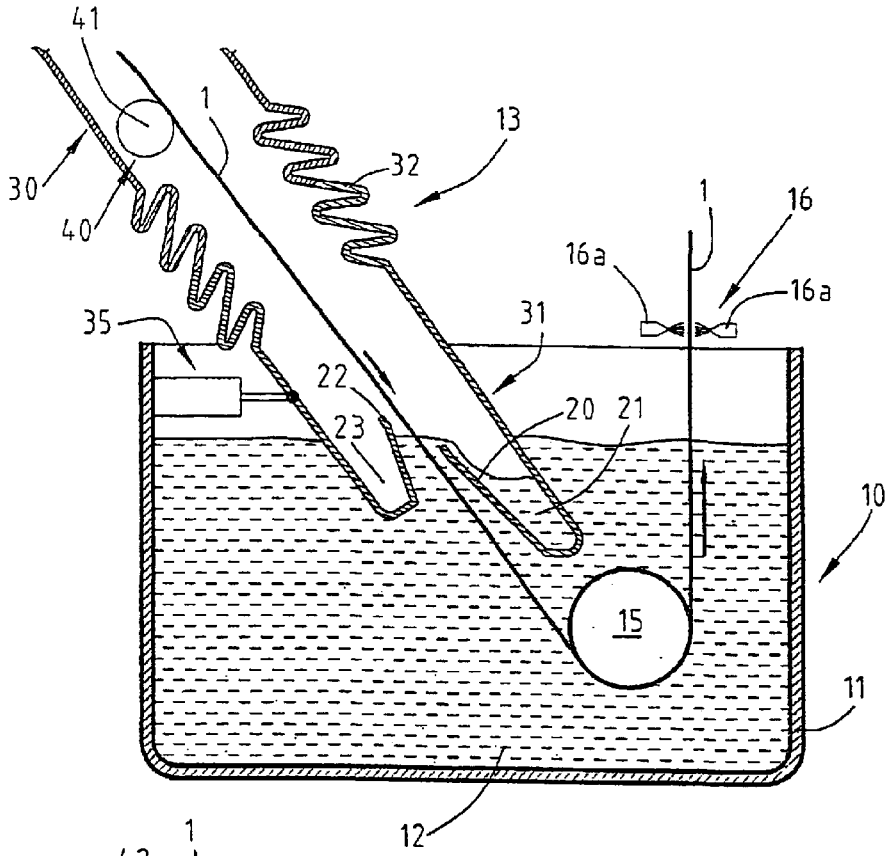
FIGS. 5 and 6 are schematic views showing two embodiments of the means for guiding the strip inside the duct of the plant according to the invention.
Figure 6:
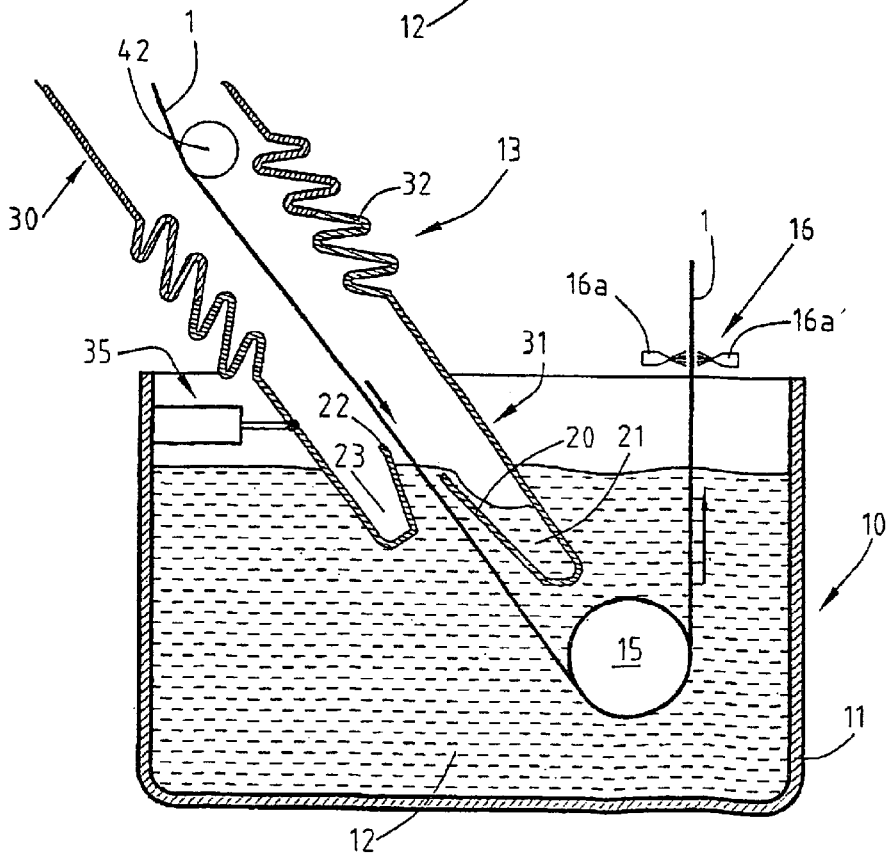

As shown in FIGS. 5 and 6, the plant includes means 40 for guiding the steel strip 1 inside the duct 13.

These guiding means 40 are formed by a deflector roller 41 or 42 placed in the duct 13 in order to adjust the line along which the steel strip 1 runs with respect to the roller 15 and control more easily the passage of the said steel strip 1 between the two walls 20 and 22 of the compartments 21 and 23.

In the case of a thin steel strip, the deflector roller 41 is placed on that face of the strip 1 on the opposite side to that in contact with the roller 15, as shown in FIG. 5, and in the case of a thicker steel strip 1 the deflector roller 42 is placed on that face of the strip 1 which is in contact with the drive roller 15, as shown in FIG. 6.

In this case, the deflector roller 42 makes it possible to compensate for the bending of the steel strip 1 in the transverse direction, which is due to the deformation gradient of the fibres of the steel strip, through its thickness, on the rollers in the furnace upstream of the galvanizing tank.

The invention applies to any metal dip-coating process.

What is claimed is:

1. A plant for the continuous dip-coating of a metal strip (1), comprising:

a tank (11) containing a liquid metal bath (12), a duct (13) through which the metal strip (1) in a protective atmosphere runs and the lower end (13*a*) of which duct (13) is immersed in the metal bath (12) in order to define with the surface of the metal bath (12), and inside the duct (13), a liquid metal seal (14), a roller (15), placed in the metal bath (12), for deflecting the metal strip (1) and means (16) for wiping the coated metal strip (1) on leaving the metal bath (12), characterised in that the duct (13) is extended, in its lower part (13*a*), by at least two internal walls (20; 22) each located on one side of the strip (1) and directed towards the surface of the metal bath (12) in the duct (13) in order to form at least two compartments (21; 23) for recovering metal oxide particles and intermetallic compound particles, and in that the duct (13) has a fixed upper part (30) and a movable lower part (31) joined together by a deformable element (32) formed by a bellows, and means (35), for positioning the movable lower part (31) of the duct (13) with respect to the metal strip (1), comprising two actuating members (35*a*, 35*b*), linked to the lower part (31), to move the lower part in translation parallel to the surface of the metal bath (12).

2. Plant according to claim 1, characterised in that the two actuating members (35*a*, 35*b*) also move the lower part (31) of the duct (13) by pivoting about an axis transverse to the strip (1) and located in the region of the deformable element (32).

3. Plant according to claim 1, characterised in that the actuating members (35*a*; 35*b*) are formed by hydraulic or pneumatic cylinders.

4. Plant according to claim 1, characterised in that it includes means (40) for guiding the metal strip (1) inside the duct (13).

5. Plant according to claim 4, characterised in that the guiding means (40) are formed by a deflector roller (41) placed on that face of the strip (1) on the opposite side to that in contact with the deflector roller (15).

6. Plant according to claim 4, characterised in that the guiding means (40) are formed by a deflector roller (42) placed on that face of the strip (1) which is in contact with the deflector roller (15).

7. The plant according to claim 1, wherein the bellows is made of stainless steel.

* * * * *